US007097157B1

(12) United States Patent
Lodrick

(10) Patent No.: US 7,097,157 B1
(45) Date of Patent: Aug. 29, 2006

(54) MODULAR ADJUSTABLE HOIST

(76) Inventor: Lester B. Lodrick, 603 E. Myers, Hazel Park, MI (US) 48030

( * ) Notice: Subject to any disclaimer, the term of this patent is extended or adjusted under 35 U.S.C. 154(b) by 635 days.

(21) Appl. No.: 10/115,641

(22) Filed: Apr. 3, 2002

(51) Int. Cl.
*B66D 1/12* (2006.01)
*A47H 1/08* (2006.01)
*B42F 13/00* (2006.01)

(52) U.S. Cl. ..... 254/362; 211/105.4; 248/342

(58) Field of Classification Search ..... 254/362, 254/366, 262, 263; 211/105.4, 105.5, 105.6, 211/175; 248/342, 343, 351, 906; 212/179
See application file for complete search history.

(56) References Cited

U.S. PATENT DOCUMENTS 2,293,168 A * 8/1942 Pirone ..... 211/123
3,520,514 A * 7/1970 Evans ..... 248/163.2
3,802,666 A * 4/1974 Haberthier ..... 254/362
4,296,509 A * 10/1981 Simmons et al. ..... 5/85.1
4,458,882 A 7/1984 Schorling ..... 254/332
4,461,460 A 7/1984 Telford ..... 254/344
4,708,048 A * 11/1987 Brown et al. ..... 89/1.805
5,337,908 A * 8/1994 Beck, Jr. ..... 212/312
5,433,551 A * 7/1995 Gordon ..... 403/377
6,082,561 A 7/2000 Bembas ..... 212/180
6,334,590 B1 1/2002 Landry ..... 244/137.1

* cited by examiner

*Primary Examiner*—Kathy Matecki
*Assistant Examiner*—Evan Langdon
(74) *Attorney, Agent, or Firm*—Young & Basile, P.C.

(57) ABSTRACT

A modular adjustable hoist has a winch and a cable for hoisting an object. An electric motor is coupled to the winch for winding and unwinding the cable. An adjustable frame is used for securing the winch to a support or in a free standing position. The support can include a door frame, a wall, and an automotive vehicle. Legs can be attached to the adjustable frame for providing stability to the hoist for use with or without the structural support.

16 Claims, 7 Drawing Sheets

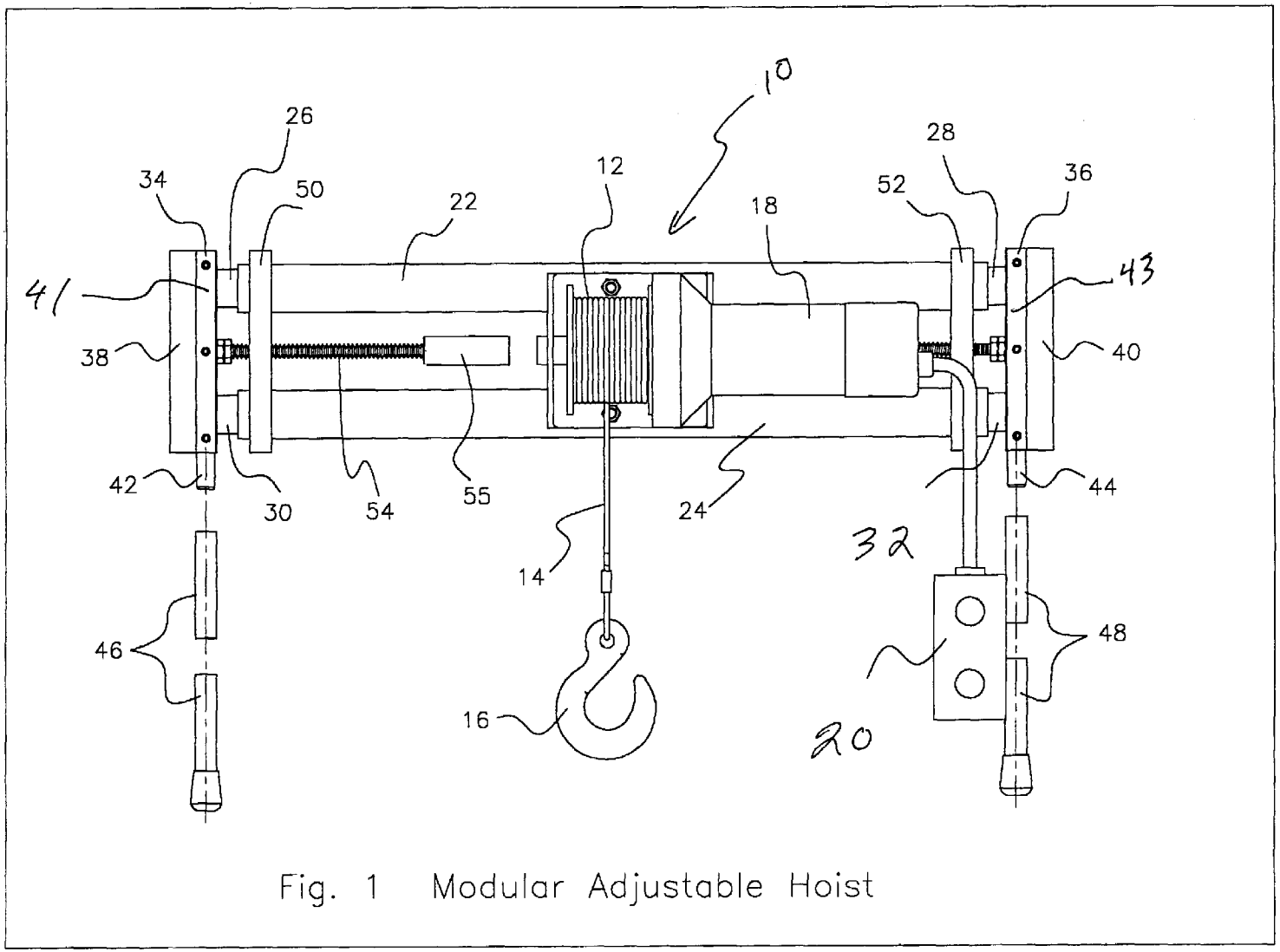
Fig. 1 Modular Adjustable Hoist

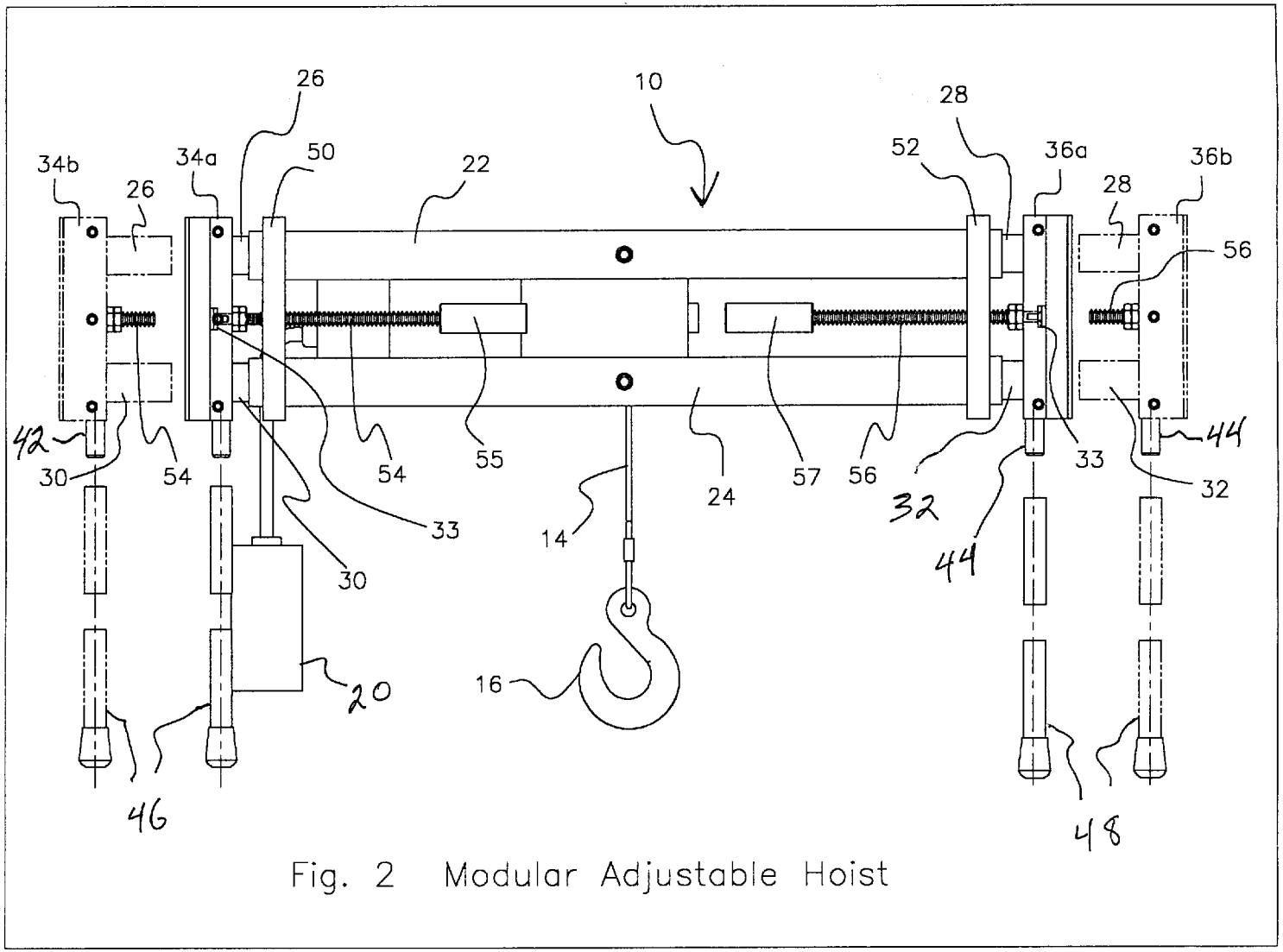
Fig. 2 Modular Adjustable Hoist

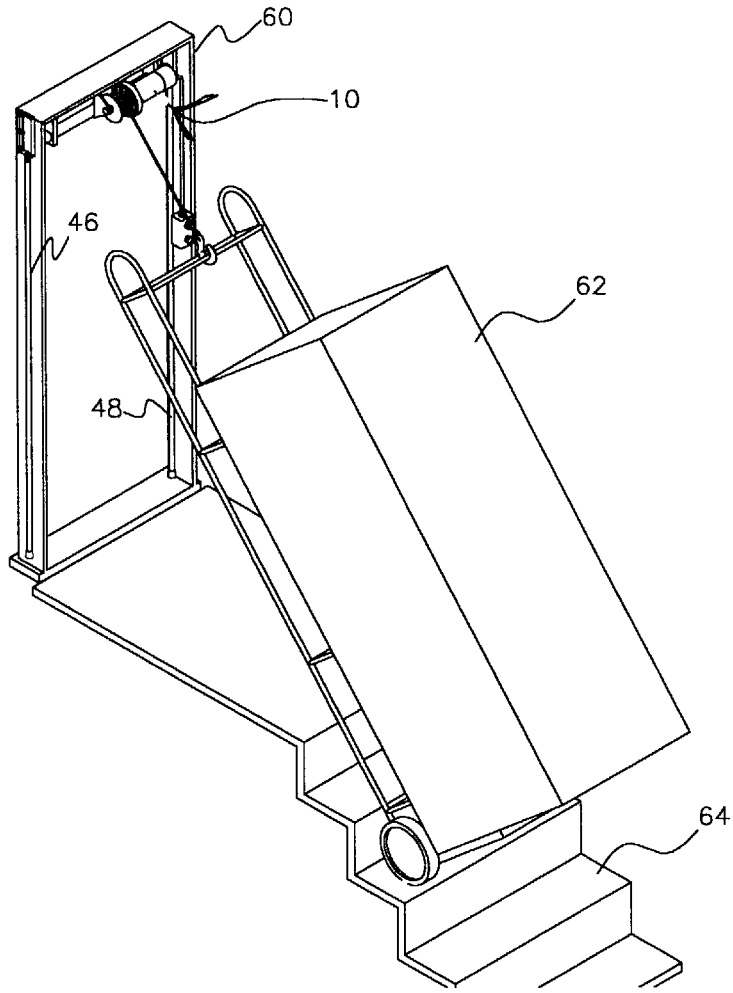
Fig. 3 Modular Adjustable Hoist Door Frame Configuration

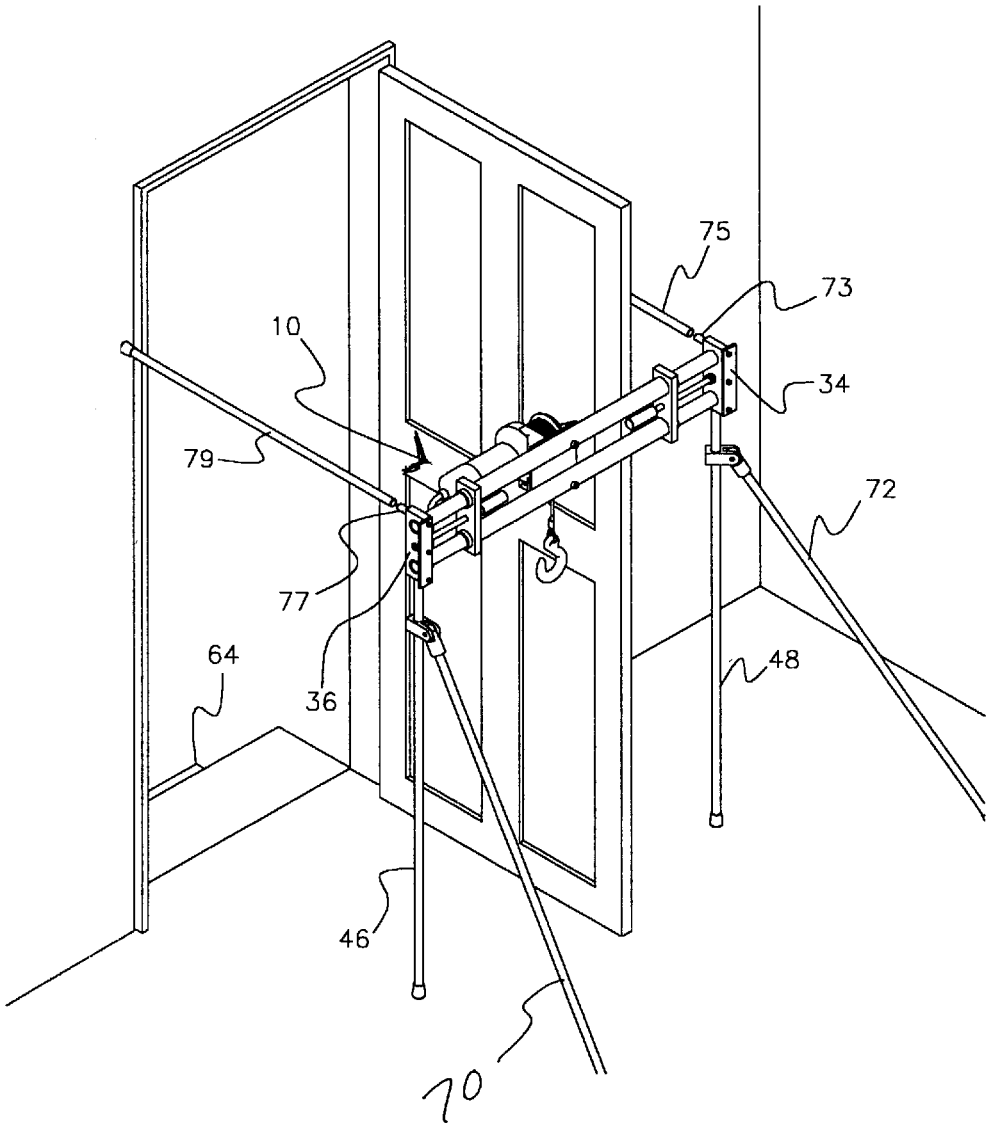
Fig. 4 Modular Adjustable Hoist Doorway Configuration

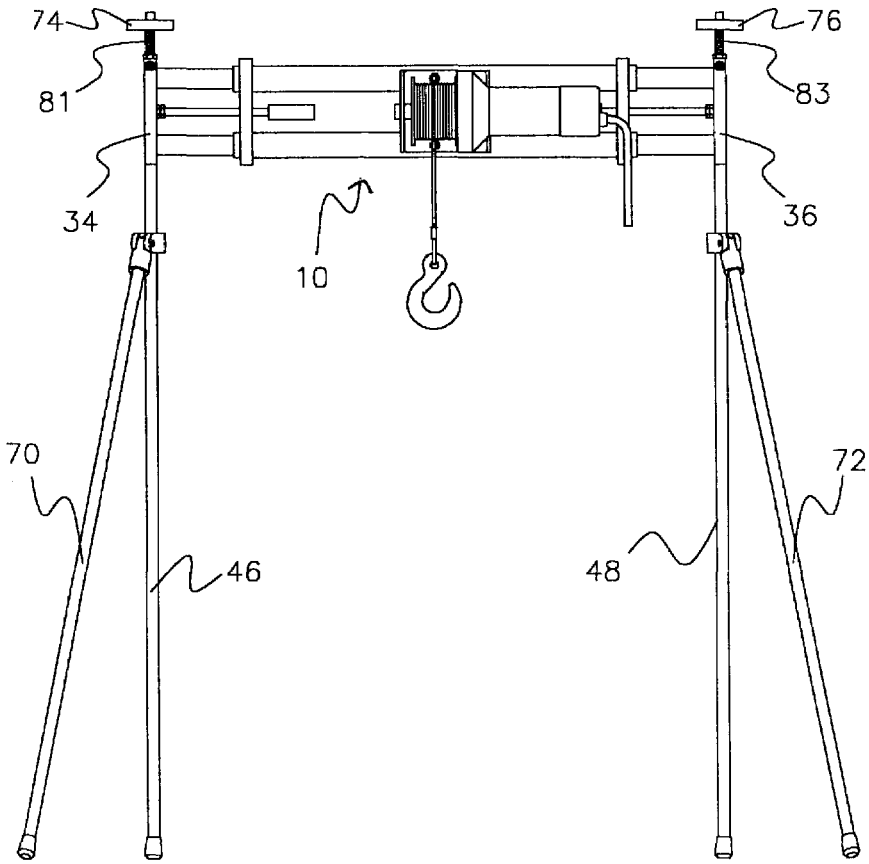
Fig. 5 Modular Adjustable Hoist Vehicle Configuration

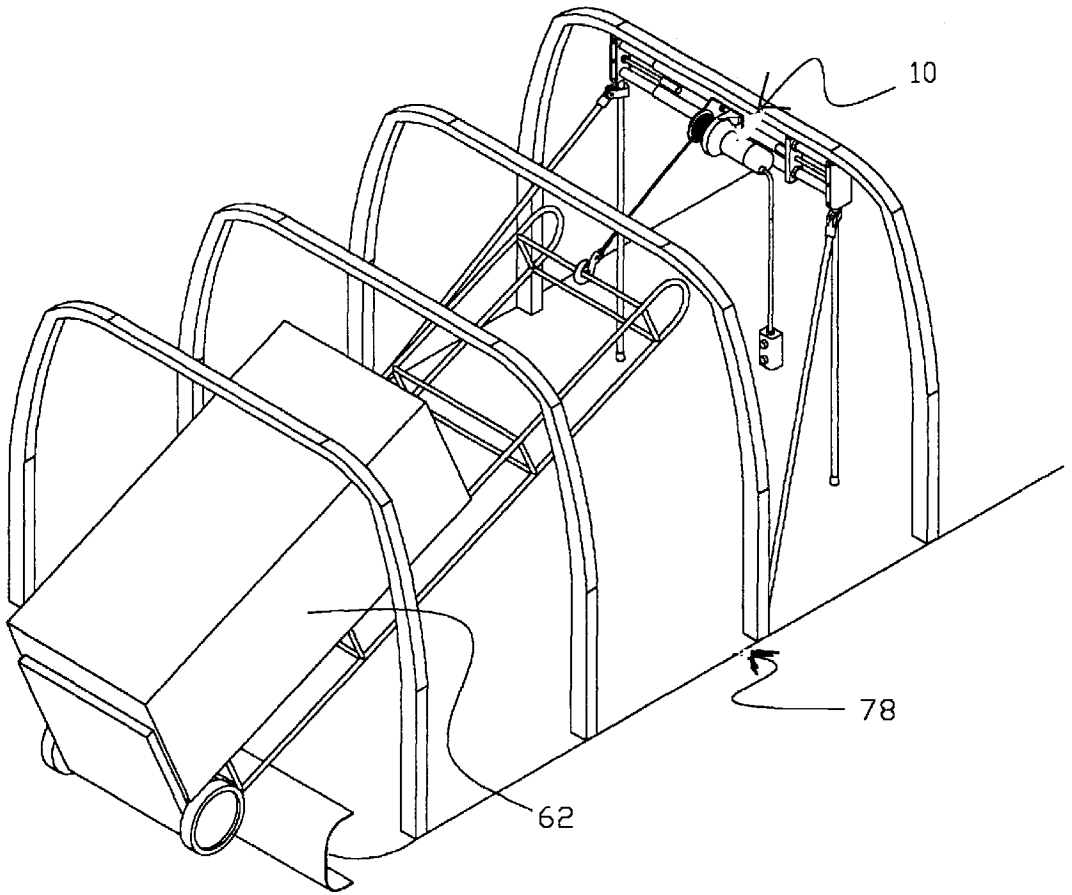
Fig. 6 Modular Adjustable Hoist Vehicle Configuration Showing Load being Pulled

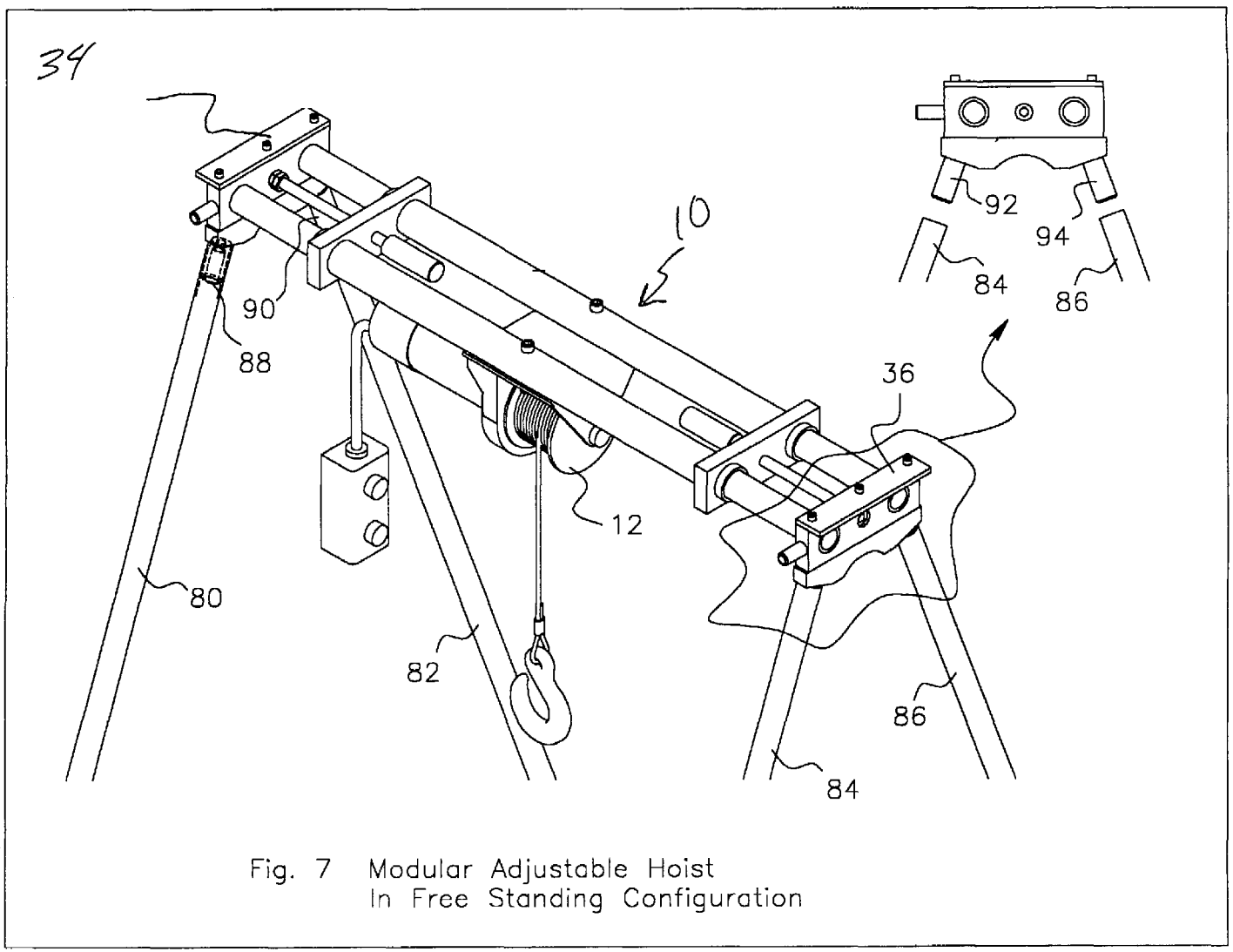
Fig. 7 Modular Adjustable Hoist In Free Standing Configuration

MODULAR ADJUSTABLE HOIST

FIELD OF THE INVENTION

The present invention relates to a modular adjustable hoist that is portable and can be utilized in multiple configurations.

BACKGROUND OF THE INVENTION

Devices for hoisting cargo are well known in the art. Often these devices take up a substantial amount of room and are very immobile and heavy. A hoist typically includes a winch having a cable wound on a drum which is typically driven by a reversible electric motor. The cable usually has a hook on it for attaching to an object to be moved from one location to another.

Despite numerous hoist designs on the market today, there continues to be a need for a relatively compact, lightweight, portable, and adjustable hoist for a typical homeowner or business person needing to lift heavy objects up flights of stairs, into a cargo van, or into a free standing position off the ground.

SUMMARY OF THE INVENTION

An apparatus according to the present invention having different configurations for hoisting objects in a variety of locations. A modular adjustable hoist with a winch has a cable wound on a drum and has an attachment member at one end of the cable to attach to an object. An electric motor is coupled to the drum for winding and unwinding the cable and an adjustable frame for securing the winch to a structural support. In the first aspect, the structural support can be a door frame. The adjustable hoist is secured to the door frame for lifting a heavy object up a flight of stairs. The adjustable hoist has first and second outer cylindrical members with two inner cylindrical members internal to the outer members. The first and second inner cylindrical members are telescopically disposed in each of the outer cylindrical members, such that the inner cylindrical members can retract inwardly and extend outwardly from the first and second ends of the outer cylindrical members.

A pair of end blocks are attached to the inner cylindrical members, and can be secured against the sides of the door frame in a locked position to provide support for the adjustable hoist. A pair of vertical extensions are attachable to the end blocks. The vertical extensions rest on the floor underneath the door frame to provide further support of the adjustable hoist.

A second aspect uses sidewalls of a doorway as the structural support. This is a variation of the door frame configuration in that the modular adjustable frame can be used in a doorway, without actually being wedged into the door frame itself. A pair of horizontal extensions are attached to the end blocks and butted up against a vertical surface next to the door frame so that the load can be pulled up a stairway with a winch wherein the forces are transmitted through the horizontal extensions into the wall next to the door frame.

In a third aspect, the modular adjustable hoist can be used in a truck or a cargo van to pull heavy loads up into the bed of the vehicle. The modular adjustable hoist is basically set up with the same configuration as the door frame configuration except for an additional leg extension attached to each of the vertical leg extensions. When utilizing a cargo van, a bolt with a pad on one end is attached to each end block and can be adjusted inwardly or outwardly relative to the end blocks for pressing up against the roof of the cargo van to provide additional stability for the hoist.

In a fourth aspect, the modular adjustable hoist can be configured into a free standing lift. The adjustable frame is rotated 90 degrees and four leg extensions are attached to the end blocks. Each leg is at an oblique angle relative to each other, similar to a saw horse configuration, for providing stability to the adjustable hoist when lifting heavy objects off of a surface.

The advantage of this invention is that a hoist is designed in a relatively compact, lightweight, portable and adjustable way so that a typical homeowner or business person can lift heavy objects up flights of stairs or into a cargo van. This hoist is easy to set up in any configuration by one individual.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 1 is a perspective view of a modular adjustable hoist according to the present invention;

FIG. 2 is a bottom elevational view of the jack screw mechanism for the modular adjustable hoist;

FIG. 3 is a perspective view of a first aspect of a modular adjustable hoist mounted in a door frame configuration;

FIG. 4 is a perspective view of a second aspect of a modular adjustable hoist mounted in a doorway configuration;

FIG. 5 is a perspective view of a third aspect of a modular adjustable hoist mounted in a vehicle configuration;

FIG. 6 is a perspective view of the third aspect of the modular adjustable hoist lifting a load into a cargo van; and FIG. 7 is a perspective view of a fourth aspect of a modular adjustable hoist in a free standing configuration.

DETAILED DESCRIPTION

A modular adjustable hoist according to the present invention in various aspects is illustrated in FIGS. 1–7. The modular adjustable hoist 10 is shown in FIG. 1. The hoist 10 has a winch 12 with a cable 14 and an attachment means 16 on the end of the cable 14. The hoist 10 is driven by an electric motor 18 which is used for lifting or lowering an object. A control, such as Dayton controller 20, is used to control the motor 18. The modular adjustable hoist 10 has a first outer cylindrical member 22 and a second outer cylindrical member 24. These outer cylindrical members 22, 24 can be tubes made of various materials depending on the stress induced into the apparatus in the loaded condition. If the load is relatively low, the hoist 10 can be made of aluminum and for heavier loads a high carbon steel material would be more appropriate. There are two inner cylindrical members inside each outer cylindrical member 22, 24. A first inner cylindrical member 26 and a second inner cylindrical member 28 telescopically engages with outer cylindrical member 22. A first inner cylindrical member 30 and a second inner cylindrical member 32 telescopically engages with outer cylindrical member 24. Inner cylindrical members 26 and 30 are mechanically attached to one end block 34 and inner cylindrical members 28 and 32 are mechanically attached to the another end block 36. Both end blocks 34, 36 have a protective cushion 38, 40 on an outer wall so that when the adjustable hoist 10 is extended into sidewalls of a door frame 60, the hoist 10 and the door frame 60 are protected. The protective cushions 38, 40 can be made of any soft material such as a rubber, cloth, or foam. The protective cushions 38,40 are held in position by top plates 41 and 43. Top plates 41,43 are connected to the end plates 34,36 by fasteners such as screws, bolts, or rivets. The protective cushions 38,40 are trapped between the end blocks 34,36 and the top plates 41,43.

Each end block 34, 36 has a dowel pin pressed into an end wall 42, 44 to allow leg extensions 46 and 48 to slide over the dowel pins 42, 44 to provide vertical support for the adjustable hoist 10 in a door frame configuration. There are two reaction blocks 50, 52 attached to the outer cylindrical members 22, 24. Both of these reaction blocks 50, 52 have threaded-through bores for threaded engagement with threaded rods or jackscrews 54, 56. The jackscrews 54, 56 engage through the reaction blocks 50, 52 and connect to the end blocks 34, 36. The jackscrews 54, 56 having knobs or handles 55, 57 are bidirectionally turnable such that the end blocks 34, 36 will move inwardly or outwardly with respect to the outer cylindrical members 22,24 depending on the direction of rotation of the knobs 55, 57. A bolt assembly 33 connects each end block 34,36 to jackscrews 54,56 so that the end blocks 34,36 can be pushed outward or pulled inward depending on the direction of rotation of the jackscrews 54,56. The bolt assembly 33 includes two locking nuts on the inside of each end block 34,36 and a screw and washer combination on the outside of each end block 34,36 threadably engaged with each jackscrew 54, 56.

Referring now to FIG. 2, the jackscrew mechanisms are shown in a close up view. The end blocks 34, 36 are shown in retracted positions at 34*a* and 36*a* and in extended positions at 34*b* and 36*b*. The inner cylindrical members 26, 28, 30, 32 can slide out of the outer cylindrical members 22, 24 until the inner cylindrical members 26, 28, 30, 32 are stopped by either door frame or by the handle engaging with the reaction blocks 50,52. Assembly 33 is used in combination with the handles 55,57 of the jackscrews 54,56 to operate as an end stop for preventing the inner members 26, 28, 30, 32 from sliding completely out of outer members 22, 24.

Now referring to FIG. 3, a modular adjustable hoist 10 is depicted positioned in a door frame configuration. The hoist 10 is placed into the door frame 60 such that an object 62 can be lifted up a flight of stairs 64. The end blocks 34, 36 are extended by turning the knobs 55 and 57 in a direction that forces the jackscrews 54, 56 to extend outwardly from the outer cylindrical members 22, 24. Leg extensions 46 and 48 can be inserted prior to or after the adjustable hoist 10 is wedged in-between the door frame sides 60. Once the end blocks 34, 36 are engaged with the door frame 60 and the vertical extension members 46, 48 are in contact with the floor, then object 62 can be hoisted up the stairs 64.

Now referring to FIG. 4, a second aspect of the adjustable hoist 10 can be used in a doorway configuration. The modular adjustable hoist 10 is in basically the same configuration as the door frame configuration except that two horizontal extension members 75 and 79 are attached to pins 73 and 77 on the end blocks 34, 36 such that the horizontal extension members 75 and 79 can be placed against the wall adjacent to the door frame for support of the adjustable hoist 10. An object 62 can be lifted up the stairs 64 in the same manner as the door frame configuration without requiring the modular adjustable hoist 10 to be wedged into a door frame. Additionally, a support leg 72 is attached to a vertical extension member 48 in the doorway configuration.

Now referring to FIG. 5, a third aspect of the modular adjustable hoist 10 can be configured for use in a vehicle such as a cargo van. The adjustable hoist 10 has the same elements as shown in FIG. 1, with the addition of two support legs 70, 72 and two pads 74, 76 on top of the hoist 10. The first support leg 70 is attached to vertical extension 46 and the second support leg 72 is attached to the vertical extension 48 to counteract lateral forces applied to the adjustable hoist 10 as an object is being moved. Additionally, two bolts 81, 83 having pads 74, 76 on the ends thereof are threadably engaged into the end blocks 34, 36 such that the bolts 81, 83 can be retracted or extended by turning each bolt 81, 83 in the correct direction. The pads 74, 76 engage the roof of the automotive vehicle to provide stiffness and support to the adjustable hoist 10 when lifting an object. FIG. 6 shows the adjustable hoist 10 pulling a load 62 into the back of a van 78.

FIG. 7 shows a fourth aspect of the invention as the adjustable hoist 10 is mounted in a free standing configuration. The modular adjustable frame 10 is rotated 90 degrees from the doorframe configuration shown in FIG. 1 such that the winch 12 is facing downward. The end blocks 34, 36 each have two pins 88, 90 and 92, 94, respectively, located at oblique angles from each other relative to the end blocks 34 and 36. The pins 88, 90, 92 and 94 protrude outwardly for mounting the adjustable hoist 10 onto the support members 80, 82, 84 and 86.

The invention claimed is:

1. A modular adjustable hoist comprising:

a winch having a cable for hoisting an object;

an electric motor coupled to the winch for winding and unwinding the cable; and an expandible frame fixedly carrying the motor and the winch, the frame having opposed, expandible end portions adaptable for fixedly securing the frame to opposed supports separate from the hoist, the frame having a pair of substantially vertical fixed members for vertically supporting the frame.

2. A modular adjustable hoist comprising:

a winch having a cable for hoisting an object;

an electric motor coupled to the winch for winding and unwinding the cable; and an expandible frame fixedly carrying the motor and the winch, the frame adaptable for fixedly securing the motor and winch to a support having a pair of substantially vertical fixed members, the adjustable frame being outwardly extendable for clamping between the pair of fixed members, the adjustable frame including:

a first and a second outer cylindrical member, each with first and second ends;

a first inner cylindrical member having a first end and a second end and a second inner cylindrical member having a first end and a second end, the first and second inner cylindrical members being telescopically disposed within each of the first and second outer cylindrical members respectively such that the first and second ends of the first and second inner cylindrical members respectively can retract inwardly and extend outwardly from the first and second ends of the outer cylindrical members; and a first end block and a second end block operable for contacting the fixed members and preventing the adjustable frame from moving relative to the fixed members, the first end block attached to the first ends of the first inner cylindrical members and the second end block attached to the second ends of the second inner cylindrical members, such that the first and second inner cylindrical members move with the end blocks and thereby telescopically extend and retract relative to the first and second outer cylindrical members.

3. The hoist of claim 2, further comprising:

means for moving the first and second end blocks into a fixed position.

4. The hoist of claim 3, wherein the end block moving means comprises:

two reaction blocks attached to the outer cylindrical members, each having a threaded through bore in which a threaded rod having a first end and a second end can react against for extending and retracting the first and second end blocks relative to each other;

each threaded rod being threadably engaged through the reaction blocks, the first ends of each threaded rod contacting the first and second end blocks respectively; and each threaded rod being bi-directionally movable for moving the first and second end blocks relative to the reaction blocks.

5. The hoist of claim 2 further comprising:

a pin permanently mounted in each of the first and second end blocks; and a vertical tubular support leg slidingly engagable over a respective in for removably connecting the support legs to the adjustable frame.

6. The hoist of claim 2, further comprising:

a protective member carried on each of the first and second end blocks.

7. The hoist of claim 6, wherein the protective member is made of resilient material.

8. The hoist of claim 2, further comprising:

means for providing additional vertical support of the adjustable frame.

9. The hoist of claim 8, wherein the vertical support means comprises:

a first tubular leg having a first end and a second end, the first end of the first tubular leg being connected to the first end block;

a second tubular leg having a first end and a second end, the first end of the second tubular leg being connected to the second end block; and the second ends of the tubular legs adapted to be operably positioned on a surface for supporting the adjustable frame in a doorframe.

10. The hoist of claim 9, wherein the first tubular leg is connected to the first end block by engaging with a pin in the first end block and the second tubular leg is connected to the second end block by engaging with a pin located in the second end block.

11. The hoist of claim 2, further comprising:

means for providing an expansion restraint for keeping the adjustable frame from over expanding.

12. The hoist of claim 11, wherein the restraint means is a handle mounted on the first end of each threaded rod for operably restricting the movement of the end blocks when the handles contact the reaction blocks.

13. The hoist of claim 1, wherein the adjustable frame further comprises:

a protective member attached to opposing ends of the support for protecting the fixed members.

14. The hoist of claim 13, wherein the protective member is made of resilient material.

15. The hoist of claim 4, further comprising:

means for providing an expansion restraint for keeping the adjustable frame from over expanding.

16. A modular adjustable hoist comprising:

a winch having a cable for hoisting an object;

an electric motor coupled to the winch for winding and unwinding the cable; and an expandible frame fixedly carrying the motor and the winch and fixedly securing the motor and winch to a support;

the adjustable frame including:

a first and a second outer cylindrical member, each with first and second ends;

a first inner cylindrical member having a first end and a second end and a second inner cylindrical member having a first end and a second end telescopically disposed within each of the first and second outer cylindrical members respectively such that the first and second ends of the first and second inner cylindrical members respectively can retract inwardly and extend outwardly from the first and second ends of the outer cylindrical members; and a first end block and a second end block operable for contacting the fixed objects and preventing the adjustable frame from moving relative to the fixed objects, the first end block attached to the first ends of the first inner cylindrical members and the second end block attached to the second ends of the second inner cylindrical members, such that the first and second inner cylindrical members move with the end blocks and thereby telescopically extend and retract relative to the first and second outer cylindrical members;

means for moving the first and second end blocks into a fixed position;

the end block moving means includes:

two reaction blocks attached to the outer cylindrical members, each having a threaded through bore in which a threaded rod having a first end and a second end can react against for extending and retracting the first and second end blocks relative to each other;

each threaded rod being threadably engaged through the reaction blocks, the first ends of each threaded rod contacting the first and second end blocks respectively;

each threaded rod being bi-directionally movable for moving the first and second end blocks relative to the reaction blocks;

means for providing an expansion restraint for keeping the adjustable frame from over expanding; and a handle mounted on the first end of each threaded rod for operably restricting the movement of the end blocks when the handles contact the reaction blocks.

* * * * *